US005860302A

United States Patent [19]

James

[11] Patent Number: 5,860,302

[45] Date of Patent: Jan. 19, 1999

[54] LATCH-LOCK STRUCTURE

[75] Inventor: Brent A. James, Williamsville, N.Y.

[73] Assignee: Diversified Control, Inc., Orchard Park, N.Y.

[21] Appl. No.: 829,340

[22] Filed: Mar. 31, 1997

[51] Int. Cl.[6] ..... B65D 55/14

[52] U.S. Cl. ..... 70/63; 70/168; 292/83; 292/98; 292/DIG. 72

[58] Field of Search ..... 70/63, 70, 71, 70/167, 168, 169; 292/80, 83, 89, 98, 107, DIG. 72

[56] References Cited

U.S. PATENT DOCUMENTS

| | | | |
|---|---|---|---|
| 251,367 | 12/1881 | King | 292/98 |
| 272,671 | 2/1883 | England | 292/98 |
| 2,029,913 | 2/1936 | Crumrine | 292/80 |
| 2,399,812 | 5/1946 | Ledin . | |
| 2,955,861 | 10/1960 | Claud-Mantle . | |
| 2,976,714 | 3/1961 | Hofgesang | 70/71 |
| 3,100,980 | 8/1963 | Humphries | 70/71 |
| 3,391,256 | 7/1968 | Nawman . | |
| 3,392,556 | 7/1968 | Atkinson . | |
| 3,964,280 | 6/1976 | Kelton . | |
| 4,120,183 | 10/1978 | Walters | 70/63 |
| 4,813,253 | 3/1989 | Dumas . | |
| 5,345,795 | 9/1994 | James et al. . | |
| 5,412,960 | 5/1995 | James et al. . | |

*Primary Examiner*—Flemming Saether
*Attorney, Agent, or Firm*—Joseph P. Gastel

[57] ABSTRACT

A lock structure for a container having a first part carrying a resilient latch and a second part carrying a latch retainer, the lock structure including a first housing mounted on the second part and having a chamber for containing the latch retainer, and a second housing mounted on the second part of the container and containing a key-operated latch-moving member for biasing the latch out of latching engagement with the latch retainer, the latch-moving member being of a configuration to be moved to a non-unlatching position by the resilient latch when the latch-moving member is not actuated to an unlatching position by a key.

32 Claims, 4 Drawing Sheets

Fig. 1.
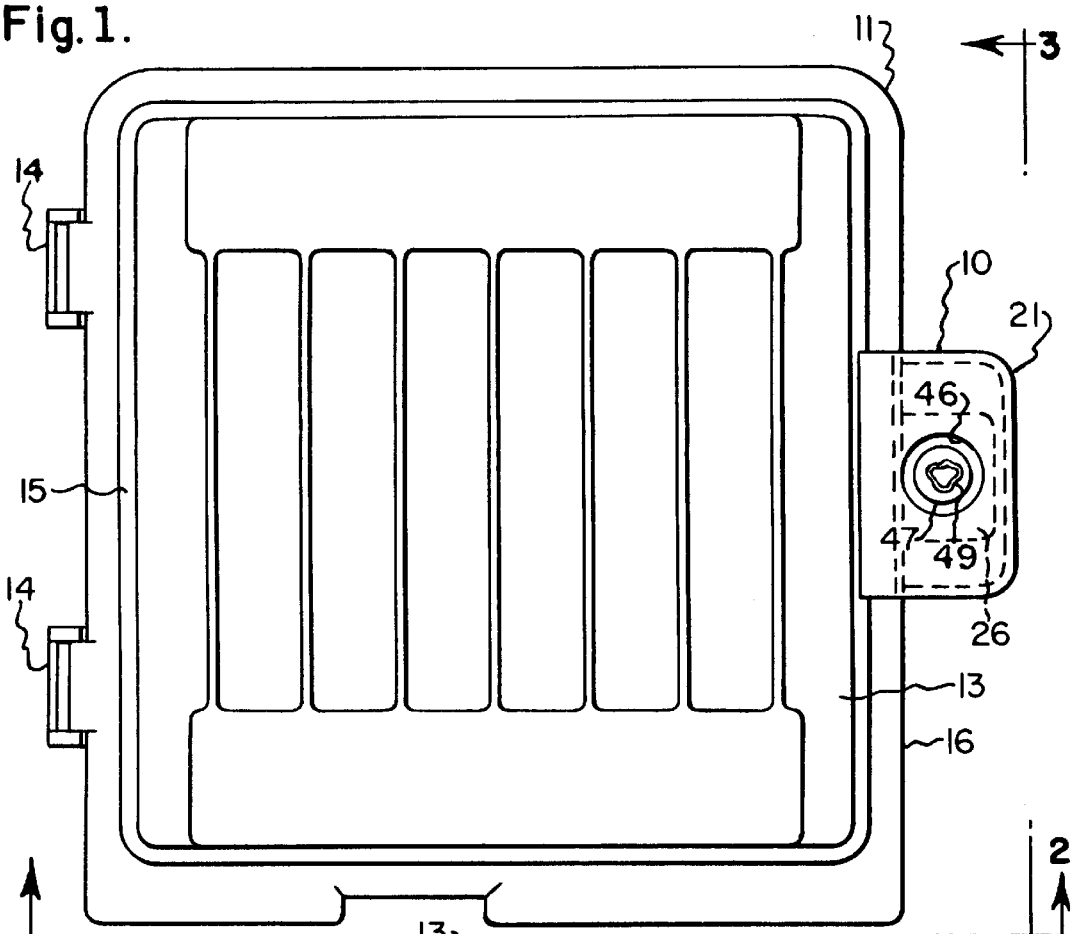
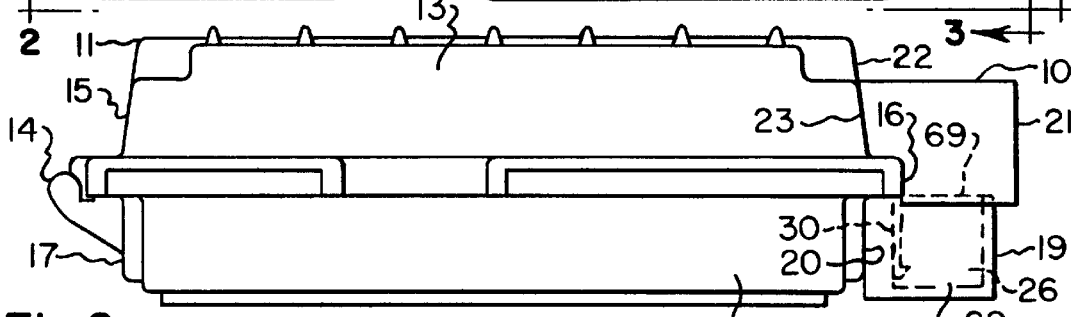
Fig. 2.
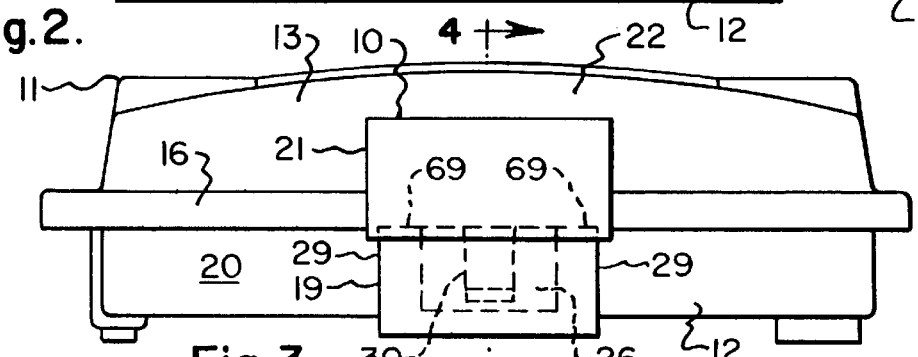
Fig. 3.

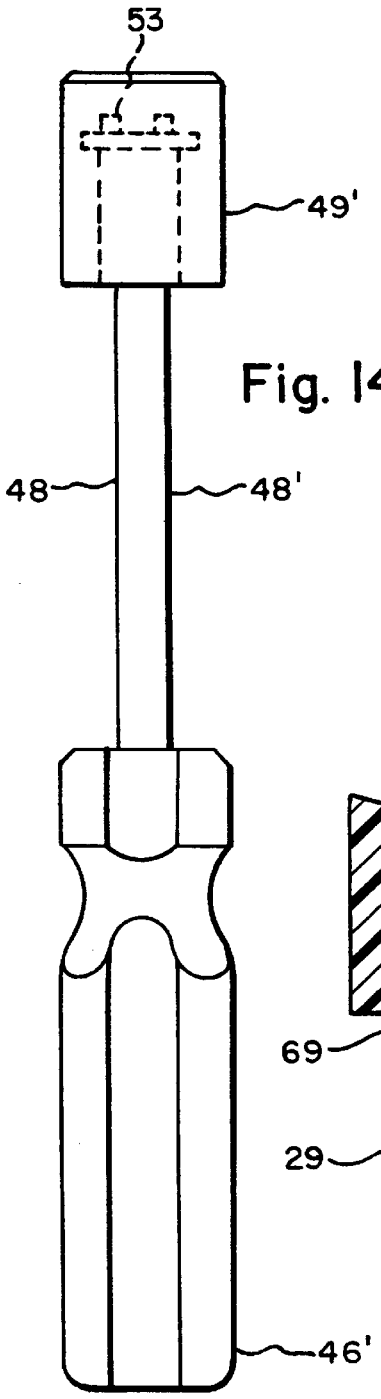
Fig. 14.
Fig. 2A.
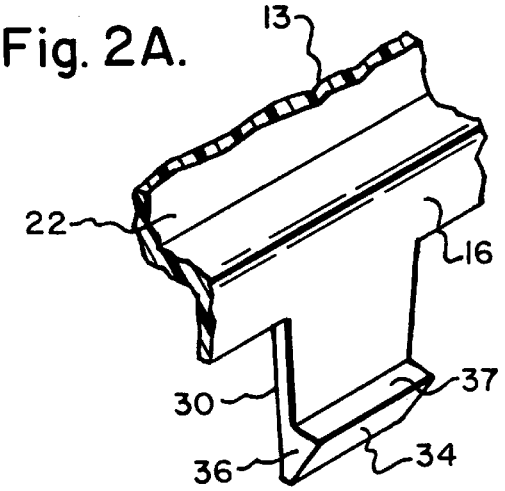
Fig. 11.
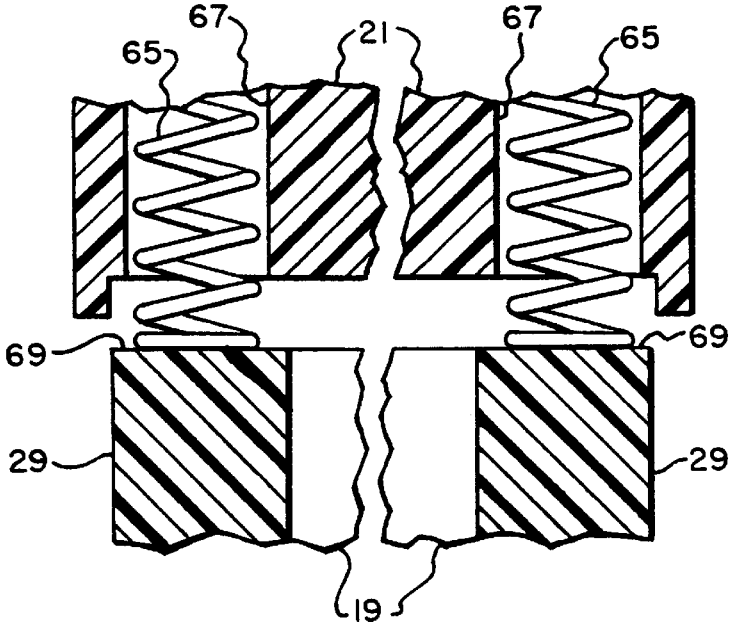

Fig. 4A.
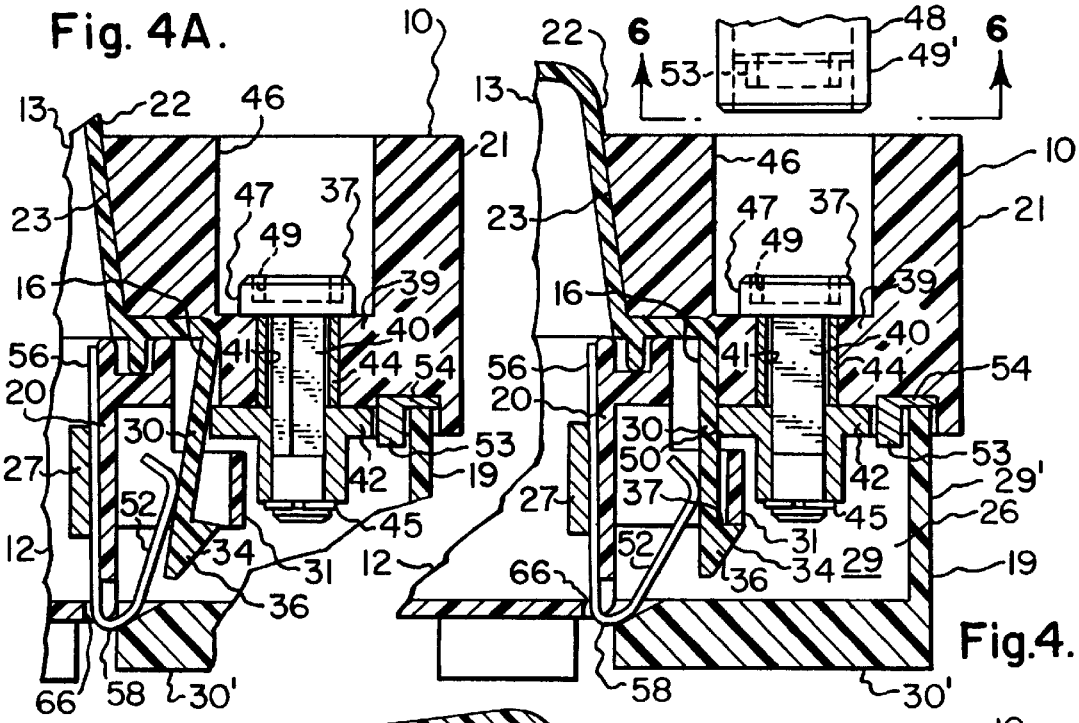
Fig.4.
Fig. 5.
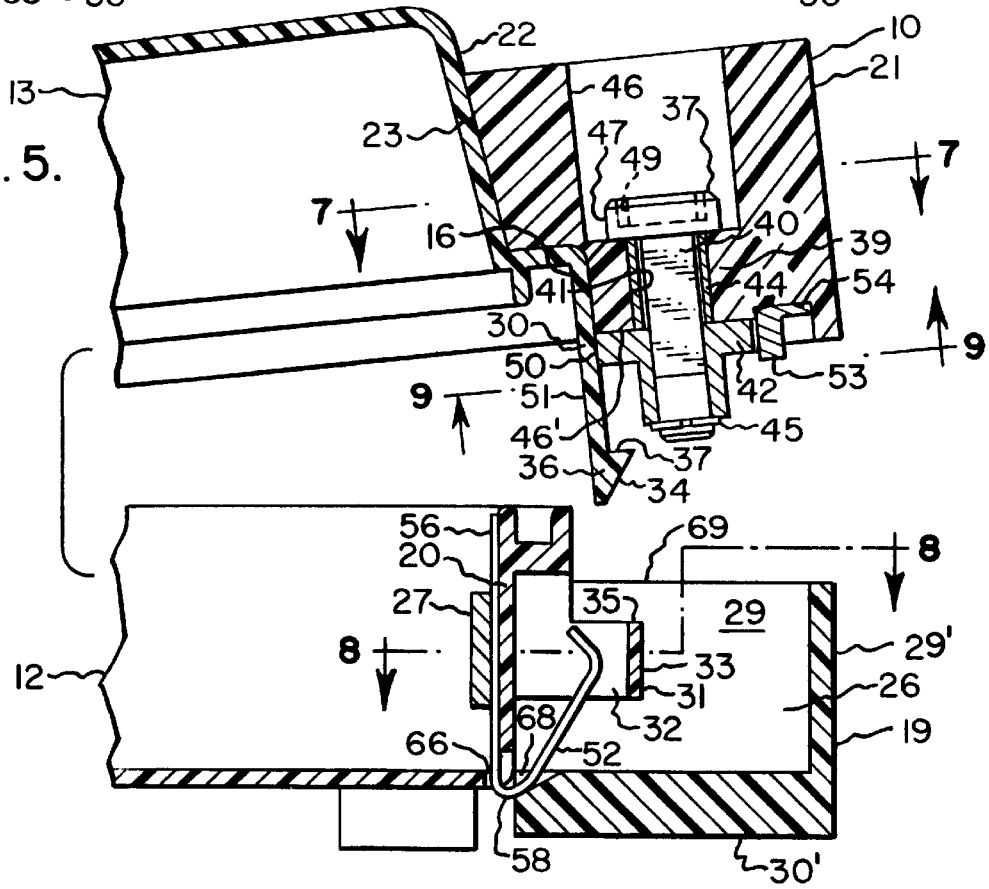

LATCH-LOCK STRUCTURE

BACKGROUND OF THE INVENTION

The present invention relates to an improved latch-lock structure for a container.

By way of background, there is in use a plastic hinged container having an exposed resilient latch structure. This latch structure consists of a latch member molded on one part and a keeper molded on the other part. The latch is exposed and it can be digitally pressed to unlatch the container. However, it is desirable to prevent unauthorized unlatching of the container.

BRIEF SUMMARY OF THE INVENTION

It is the object of the present invention to provide a housing structure for use with the existing exposed latch structure of a container to thereby prevent unauthorized unlatching of the container.

Another object of the present invention is to provide a lock structure for a latch of a container which utilizes a key for unlatching the latch but which causes the latch to spring back to a latching position when the key no longer actuates the unlatching mechanism.

A further object of the present invention is to provide an improved latch-lock structure which includes a spring arrangement which biases the parts of the container to an open position as soon as the latching structure is unlatched. Other objects and attendant advantages of the present invention will readily be perceived hereafter.

The present invention relates to a lock structure comprising a first housing for concealing a latch, a second housing, a chamber in said second housing for surrounding a latch retainer, and a key-operated latch-moving member on said first housing for moving said latch out of latching engagement with said latch retainer.

The present invention also relates to a container having a first container part, a first side on said first container part, a second container part which is movable relative to said first container part, a second side on said second container part, a latch on said first side, and a latch retainer on said second side for retaining said latch when said first and second container parts are in a closed position: a lock structure on said container comprising a first housing on said first side, a second housing on said second side, a chamber in said second housing containing said latch retainer, and a latch-moving member on said first housing positioned adjacent said latch.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 1 is a plan view of a container having the improved lock ,structure mounted thereon;

FIG. 2 is a side elevational view taken substantially in the direction of arrows 2—2 of FIG. 1;

FIG. 2A is a fragmentary perspective view, partially in cross section, of the latch which is formed integrally with the lip of the cover of the container;

FIG. 3 is an end elevational view taken substantially in the direction of arrows 3—3 of FIG. 1;

FIG. 4 is a fragmentary cross sectional view taken substantially song line 4—4 of FIG. 3 and showing the various components of the latch in a locked condition and also showing the tip of the key poised for entry into the lock housing;

FIG. 4A is a fragmentary cross sectional view similar to FIG. 4 but showing the latch of the lock moved to an unlatched condition which permits opening of the container;

FIG. 5 is a cross sectional view taken substantially along line 4—4 of FIG. 3 but showing the upper portion of a container moved away from the lower portion and showing the positions which the various parts assume after the container has been opened;

FIG. 11 is a fragmentary cross sectional view taken substantially along line 11—11 of FIG. 10 but showing the lock housing in a sprung-open condition;

FIG. 14 is a side elevational view of a key which is used to unlatch the latch.

DETAILED DESCRIPTION OF THE INVENTION

Figure 6:
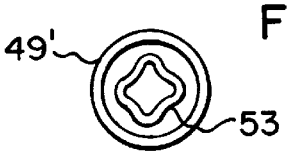
FIG. 6 is a view of the end of the key taken substantially in the direction of arrows 6—6 of FIG. 4.

The lock structure 10 of the present invention is shown mounted on prior art container 11 consisting of a bottom part 12 and a top part or cover 13 which is hingedly mounted to bottom part 12 by a pair of hinges 14 which are adjacent container sides 15 and 17.

Figure 7:
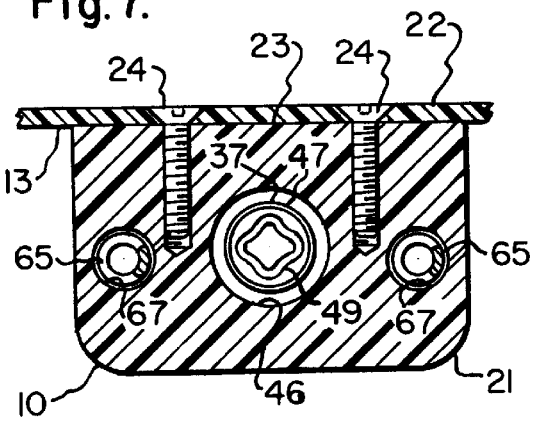
FIG. 7 is a fragmentary cross sectional view taken substantially along line 7—7 of FIG. 5 and showing the manner in which the upper housing is secured to the side of the upper part of the container.

The lock structure 10 of the present invention includes a lower housing 19 mounted on container side 20 and an upper housing 21 mounted on container side 22. More specifically upper housing 21 comprises a block of plastic which is contoured as shown at 23 in FIG. 2 to fit against both side 22 and lip 16 formed integrally with side 22. Housing 21 is secured to side 22 by a pair of bolts 24 (FIG. 7) which extend through side 22. Lower housing 19 is attached to side 20 by bolts 25 (FIG. 8) which bear against bar 27 on the inside of side 20 and extend into sides 29 of lower housing 19.

The parts of the prior art container 11 are fabricated from molded plastic, and container side 22 includes a flexible resilient latch 30 which is formed integrally with and is an extension of lip 16 (FIGS. 2A, 4A and 5). Latch 30 normally assumes an unbiased position shown in FIGS. 4 and 5. A U-shaped latch retainer or keeper 31 (FIGS. 4, 5 and 8) is molded integrally with container side 20, and it includes a cross side 33 and sides 32 (FIG. 8) which extend outwardly from side 20. When the container part 13 moves toward container part 12 to a closed position, the cam surface 34 (FIG. 5) of barb 36 of latch 30 will engage the top 35 of keeper cross side 33 and be biased to the left as cam surface 34 rides along keeper side 33 until the container reaches a closed position, whereupon the latch 30 will spring back to the position shown in FIG. 4 wherein the latch surface 37 of barb 36 underlies keeper side 33, which prevents the container part 13 from being opened away from container part 12 unless latch 30 is moved to the position of FIG. 4A. As noted above, the container, latch structure and keeper are all prior art. The lock structure consisting of housings 19 and 21 and related parts have been added to this prior structure to prevent unauthorized unlatching of the container by digitally pressing exposed latch 30 from its position of FIG. 4 to its position of FIG. 4A.

Figure 8:
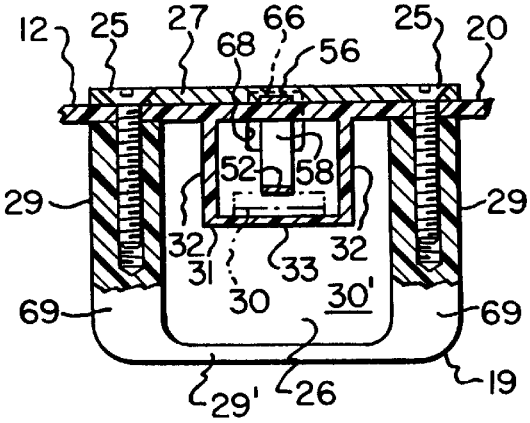
FIG. 8 a fragmentary cross sectional view taken substantially along line 8—8 of FIG. 5 and showing how the lower housing is secured to the side of the lower part of the container.
Figure 12:
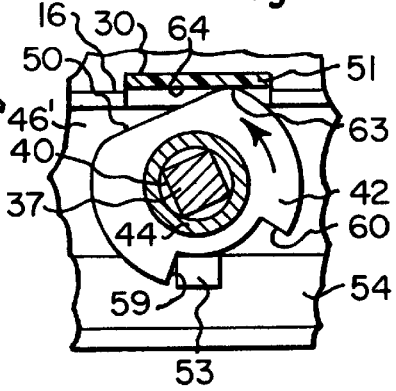
FIG. 12 is a fragmentary view of a portion of FIG. 9 and showing the cam moved in a counterclockwise direction to an unlatching position.
Figure 13:
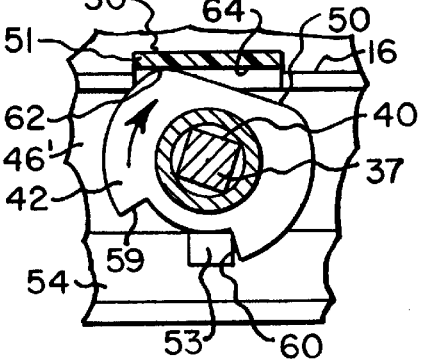
FIG. 13 is a fragmentary view similar to FIG. 12 and showing the cam moved clockwise to an unlatching position.

The lock structure 10 includes the lower housing 19 which has a chamber 26 which houses latch retainer 31 within walls 29, 29' and 30' (FIGS. 5 and 8). Upper housing 21 conceals latch 30 and mounts a key-receiving member or bolt 37 which is pivotally mounted in wall 39. More specifically, square shank 40 of bolt 37 is held in cylindrical sleeve 44 which is pivotally mounted in bore 41 in wall 39. A latch-moving member in the form of a cam 42 is keyed to the square portion 43 of shank 37, and it lies against planar substantially rectangular surface 46' (FIGS. 5, 9 and 10) of upper housing 21. A spring clip 45 retains cam 42 on bolt 37. Key-receiving member 37 includes a head 47 which has a curvilinear groove 49 therein. Head 47 is recessed within bore 46 where it cannot be grasped by a plier or wrench. Cam 42 includes an edge 50 (FIGS. 9, 12 and 13) which normally lies parallel to the elongated portion 51 of latch 30.

A key 48 (FIG. 14) is used to unlock latch 30. Key 48 includes a handle 46' and a shank 48' which mounts a sleeve 49' (FIGS. 4, 6 and 14) surrounding curvilinear ridge 53 which fits into curvilinear groove 49. Sleeve 49' fits closely into bore 46, and, in operation sleeve 49' is inserted into bore 46 and turned until ridge 53 falls into groove 49. After the curvilinear ridge 53 of key 48 is received in curvilinear groove 49 and the key 48 is turned to pivot key-receiving member 37, cam 42 can be moved from its normal position of FIG. 9 to either of the positions of FIGS. 12 or 13, depending on the direction in which key-receiving member 37 is pivoted. This moves latch 30 from the position of FIG. 4 to the position of FIG. 4A wherein the end barb 36 of the latch is disengaged from keeper side 33 so that container part 13 can move upwardly to the position of FIG. 5. The movement of latch 30 from the position of FIG. 4 to the position of FIG. 4A is opposed by spring 52 which has been added along with housing 19. Spring 52 is retained in position by spring extension 56 which is held against container side 20 by bar 27. The bend 58 of spring 52 passes through hole 66 in container part 12 and through hole 68 in housing 19 (FIG. 5).

Figure 9:
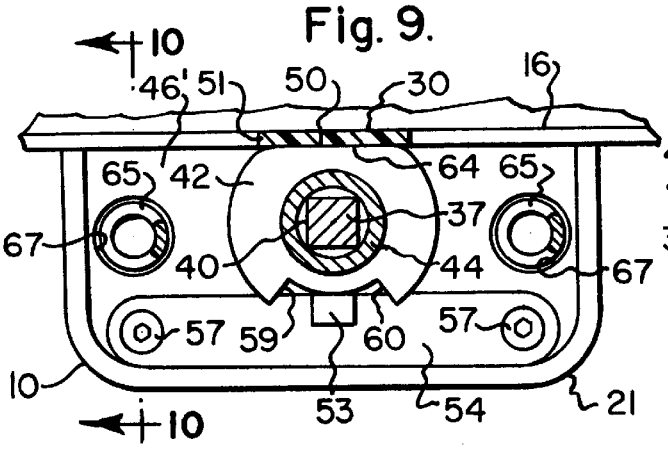
FIG. 9 is a fragmentary cross sectional view taken substantially along line 9—9 of FIG. 5 and showing the cam structure mounted on the key-receiving member and also showing the springs for biasing the housing apart when the latch is unlatched.
Figure 10:
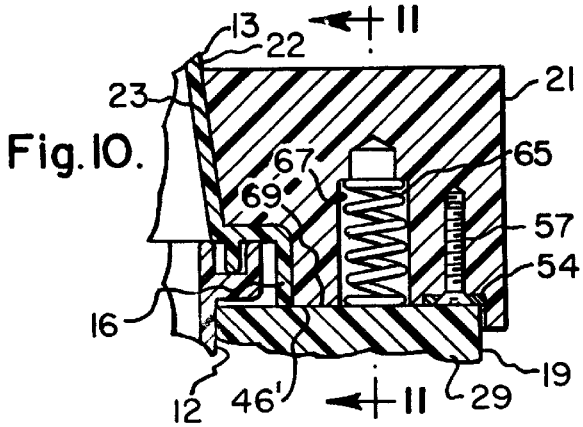
FIG. 10 is a fragmentary cross sectional view taken substantially a long line 10—10 of FIG. 9.

The pivotal movement of cam 42 is limited by boss 53 which protrudes outwardly from plate 54 which is screwed to housing wall 55 by screws 57 (FIG. 9). It can thus be seen that the ends 59 and 60 will engage boss 53 to define the limit of pivotal movement of cam 42. In each extreme limit of movement, either the edge portion 62 (FIG. 13) or the edge portion 63 (FIG. 12) engages the side 64 of resilient latch member 30. Thus, when the key 48 no longer exerts a pivotal force on key-receiving member 37, the natural resilience of latch 30 aided by the biasing force of spring 52 will move cam 42 from either of its positions of FIGS. 12 or 13 back to the neutral position of FIG. 9.

Once latch 30 has been released from its engagement with keeper 31 as described above relative to FIGS. 12 and 13, springs 65, which are housed in bores 67 and press against surfaces 69 (FIGS. 5 and 8) at the tops of sides 29 of housing 19, will spring upper housing 21 away from lower housing 19 (FIG. 11). Springs 65 are retained in bores 67 by having their upper turns distorted so as to frictionally engage the sides of the bores in which they are located.

While preferred embodiments of the present invention have been disclosed, it will be appreciated that it is not limited thereto but may be otherwise embodied within the scope of the following claims:

I claim:

1. In a container having a first container part, a first side on said first container part, a second container part which is movable relative to said first container part, a second side on said second container part, a resilient latch on said first side, and a latch retainer on said second side for retaining said resilient latch when said first and second container parts are in a closed position: the improvement including a lock structure on said container comprising a first housing added onto said first side, a second housing added onto said second side, a chamber in said second housing containing said latch retainer, a latch-moving member on said first housing positioned adjacent said latch, said latch-moving member being separate from said latch and having a normal position wherein it does not move said resilient latch to a position wherein said latch is disengaged from said latch retainer, a key-receiving member on said first housing, and said latch-moving member being coupled to said key-receiving member and being movable by said key-receiving member to a latch disengaging position wherein said resilient latch is disengaged from said latch retainer.

2. In a container as set forth in claim 1 wherein said key-receiving member comprises a shaft, a head on said shaft, and a curvilinear groove in said head for recieving a key.

3. In a container as set forth in claim 2 wherein said latch-moving member is of a configuration to be moved to said normal position by said resilient latch when said key-receiving member is not actuated by a key.

4. In a container as set forth in claim 3 including a spring for biasing said resilient latch toward said latch-moving member when said latch is in engagement with said latch retainer.

5. In a container as set forth in claim 4 including a spring mounted between said first and second housings for biasing said first and second housings apart.

6. In a container as set forth in claim 5 wherein said latch-moving member is a cam fixedly mounted on said key-receiving member.

7. In a container as set forth in claim 6 wherein said cam is of a configuration to be moved to said normal position by said resilient latch when said key-receiving member is not actuated by a key.

8. In a container as set forth in claim 2 wherein said head is recessed within a bore within said first housing.

9. In a container as set forth in claim 1 wherein said latch-moving member is a cam fixedly mounted on said key-receiving member.

10. In a container as set forth in claim 9 wherein said cam is of a configuration to be moved to said normal position by said resilient latch when said key-receiving member is not actuated by a key.

11. In a container as set forth in claim 10 including a spring for biasing said resilient latch toward said cam in all positions of said resilient latch.

12. In a container as set forth in claim 10 wherein said configuration of said cam includes at least one edge of said cam which lies adjacent to said resilient latch in said normal position, a slot in said cam, a boss on said first housing within said slot, said boss limiting the range of pivotal movement of said cam and the associated range of movement of said at least one edge so as to prevent said at least one edge from moving beyond a position which prevents said resilient latch from moving said cam back to said normal position.

13. In a container as set forth in claim 1 including a spring mounted between said first and second housings for biasing said first and second housings apart.

14. In a container as set forth in claim 13 including a second spring for biasing said resilient latch toward said latch-moving member in all positions of said resilient latch.

15. In a container as set forth in claim 14 wherein said latch-moving member is a cam fixedly mounted on said key-receiving member.

16. In a container as set forth in claim 15 wherein said cam is of a configuration to be moved to said normal position by said resilient latch when said key-receiving member is not actuated by a key.

17. In a container as set forth in claim 16 wherein said configuration of said cam includes at least one edge of said cam which lies adjacent to said resilient latch in said normal position, a slot in said cam, a boss on said first housing within said slot, said boss limiting the range of pivotal movement of said cam and the associated range of movement of said at least one edge so as to prevent said at least one edge from moving beyond a position which prevents said resilient latch from moving said cam back to said normal position.

18. In a container as set forth in claim 1 wherein said latch-moving member is of a configuration to be moved to said normal position by said resilient latch when said key-receiving member is not actuated by a key.

19. In a container as set forth in claim 18 including a spring mounted between said first and second housings for biasing said first and second housings apart.

20. A lock structure comprising a resilient latch, a first housing adjacent said resilient latch, a second housing, a latch retainer, a chamber in said second housing surrounding said latch retainer, said resilient latch and said latch retainer being concealed by said first and second housings when said latch is in latching engagement with said latch retainer, and a key-operated latch-moving member on said first housing for moving said latch out of latching engagement with said latch retainer.

21. A lock structure as set forth in claim 20 including at least one first bolt for mounting said first housing on a first container part, and at least one second bolt for mounting said second housing on a second container part.

22. A lock structure as set forth in claim 20 including at least one spring for biasing said first and second housings apart.

23. A lock structure as set forth in claim 22 including at least one first bolt for mounting said first housing on a first container part, and at least one second bolt for mounting said second housing on a second container part.

24. A lock structure as set forth in claim 22 including a spring in said second housing for biasing said latch to a latching position.

25. A lock structure as set forth in claim 24 including at least one second spring for biasing said first and second housings apart.

26. A lock structure as set forth in claim 24 wherein said latch-moving member is of a configuration to be biased by said resilient latch to a non-unlatching position when said latch-moving member is not actuated to an unlatching position.

27. A lock structure as set forth in claim 20 wherein said latch-moving member is of a configuration to be biased by said resilient latch to a non-unlatching position when said latch-moving member is not actuated to an unlatching position.

28. A lock structure as set forth in claim 27 including at least one first bolt for mounting said first housing on a first container part, and at least one second bolt for mounting said second housing on a second container part.

29. A lock structure as set forth in claim 27 including at least one spring for biasing said first and second housings apart.

30. A lock structure as set forth in claim 29 including a spring in said second housing for biasing said resilient latch to a latching position.

31. An add-on lock structure for a container having a first part carrying a resilient latch and a second part carrying a latch retainer, the add-on lock structure comprising a first housing for mounting on a first part of a container adjacent a resilient latch, a key-operated latch-moving member on said first housing, and a second housing for mounting on a second part of a container for containing a preexisting latch retainer on the container.

32. In a container having a first side having a resilient latch thereon and a second side adjacent said first side having a latch retainer thereon, an add-on lock structure comprising a first housing mounted on said first side, adjacent said resilient latch a key-operated latch-moving member on said first housing, a second housing mounted on said second side, and a chamber in said second housing containing said latch retainer.

* * * * *